US012704283B2

(12) United States Patent
Davis et al.

(10) Patent No.: US 12,704,283 B2
(45) Date of Patent: Aug. 11, 2026

(54) SYSTEMS AND METHODS FOR DEHUMIDIFICATION USING CLIMATE CONTROL SYSTEMS

(71) Applicant: Trane International Inc., Davidson, NC (US)

(72) Inventors: Amanda Davis, Austin, TX (US); Jeffrey L. Stewart, Tyler, TX (US); Dominique Schaefer Pipps, Flint, TX (US)

(73) Assignee: Trane International Inc., Davidson, NC (US)

( * ) Notice: Subject to any disclaimer, the term of this patent is extended or adjusted under 35 U.S.C. 154(b) by 131 days.

(21) Appl. No.: 18/621,739

(22) Filed: Mar. 29, 2024

(65) Prior Publication Data

US 2025/0305703 A1 Oct. 2, 2025

(51) Int. Cl.

| | |
|---|---|
| ***F24F 11/86*** | (2018.01) |
| ***F24F 3/14*** | (2006.01) |
| ***F24F 11/62*** | (2018.01) |
| ***F24F 11/77*** | (2018.01) |
| ***F24F 11/88*** | (2018.01) |

(Continued)

(52) U.S. Cl.

CPC ..... *F24F 11/62* (2018.01); *F24F 3/1405* (2013.01); *F24F 11/77* (2018.01); *F24F 11/86* (2018.01); *F24F 11/88* (2018.01); *F25B 49/022* (2013.01); *F24F 2003/1446* (2013.01); *F24F 2110/10* (2018.01); *F24F 2110/20* (2018.01); *F25B 2600/0252* (2013.01)

(58) Field of Classification Search

CPC ... F25B 2600/0252; F24F 11/77; F24F 11/86; F24F 11/88; F24F 3/1405; F24F 2003/144; F24F 2003/1446

See application file for complete search history.

(56) References Cited

U.S. PATENT DOCUMENTS

| | | |
|---|---|---|
| 8,397,522 B2 | 3/2013 | Springer et al. |
| 8,757,506 B2 | 6/2014 | Zhou et al. |

(Continued)

FOREIGN PATENT DOCUMENTS

| | | |
|---|---|---|
| EP | 1443278 B1 | 2/2007 |
| SG | 11202101366 UA | 3/2021 |

*Primary Examiner* — Jerry-Daryl Fletcher
*Assistant Examiner* — Daniel C Comings
(74) *Attorney, Agent, or Firm* — Womble Bond Dickinson (US) LLP

(57) ABSTRACT

An embodiment of a climate control system includes an indoor unit including a first heat exchanger to transfer heat between a refrigerant and an airflow provided to a conditioned space. In addition, the system includes an outdoor unit that further includes a second heat exchanger to transfer heat between the refrigerant and an outdoor environment and a compressor to circulate the refrigerant through the first and second heat exchangers. Further, the system includes a thermostat to determine a relative humidity of the conditioned space and to output a dehumidification signal in response to a determination that the relative humidity is above a threshold. Still further, the system includes an electrical switch coupled to the indoor and outdoor units that is actuatable based on the dehumidification signal to conduct electrical current from the indoor unit to the outdoor unit to increase a speed of the compressor.

15 Claims, 6 Drawing Sheets

(51) Int. Cl.

| | |
|---|---|
| ***F25B 49/02*** | (2006.01) |
| *F24F 110/10* | (2018.01) |
| *F24F 110/20* | (2018.01) |

(56) References Cited

U.S. PATENT DOCUMENTS

| | | | | |
|---|---|---|---|---|
| 10,215,425 | B2 | 2/2019 | Branson et al. | |
| 10,386,089 | B2 | 8/2019 | Goel et al. | |
| 10,670,296 | B2 | 6/2020 | Popli et al. | |
| 10,962,243 | B2 | 3/2021 | Bush et al. | |
| 10,962,249 | B2 | 3/2021 | Kohashi et al. | |
| 11,566,828 | B2 | 1/2023 | Brasuell et al. | |
| 2004/0140364 | A1* | 7/2004 | Morton, Sr. | F24F 3/14 237/12 |
| 2010/0065245 | A1 | 3/2010 | Imada et al. | |
| 2015/0008762 | A1* | 1/2015 | Higashiyama | F24F 1/20 307/113 |
| 2017/0234564 | A1* | 8/2017 | Goel | F24F 3/14 62/93 |
| 2019/0107309 | A1* | 4/2019 | Assouad | F24F 11/67 |

* cited by examiner

SYSTEMS AND METHODS FOR DEHUMIDIFICATION USING CLIMATE CONTROL SYSTEMS

CROSS-REFERENCE TO RELATED APPLICATIONS

Not applicable.

BACKGROUND

The climate of a conditioned space (e.g., such as the interior of a residential home, office space, storage unit, cold chamber, etc.) may be controlled by a climate control system. The climate control system may include a heating, ventilation, and air conditioning (HVAC) system, air conditioning system, furnace, and/or a de-humidification system, etc. While temperature may be a focus for the control and operation of such climate control systems, the relative humidity in the conditioned space may also be a relevant factor. For instance, if the relative humidity of the conditioned space is not properly controlled, property damage, occupant discomfort, and/or product (or content) spoilage may occur.

BRIEF SUMMARY

Some embodiments disclosed herein are directed to a climate control system that includes an indoor unit including a first heat exchanger that is configured to transfer heat between a refrigerant and an airflow provided to a conditioned space. In addition, the climate control system includes an outdoor unit further including a second heat exchanger that is configured to transfer heat between the refrigerant and an outdoor environment and a compressor configured to circulate the refrigerant through the first heat exchanger and the second heat exchanger. Further, the climate control system includes a thermostat that is configured to determine a relative humidity of the conditioned space and to output a dehumidification signal in response to a determination that the relative humidity is above a threshold. Still further, the climate control system includes an electrical switch coupled to the indoor unit and the outdoor unit that is actuatable based on the dehumidification signal to conduct electrical current from the indoor unit to the outdoor unit to increase an operating speed of the compressor to reduce the relative humidity in the conditioned space.

Some embodiments disclosed herein are directed to a climate control system including an indoor unit that is configured to condition an airflow for a conditioned space. In addition, the climate control system includes an outdoor unit including a compressor configured to circulate a refrigerant between the indoor unit and the outdoor unit, the compressor operable at a first speed in a first stage and operable at a second speed in a second stage, the second speed being is greater than the first speed. Further, the climate control system includes a thermostat that is configured to determine a relative humidity of the conditioned space and to output a dehumidification signal to the indoor unit in response to a determination that the relative humidity is above a threshold. Still further, the climate control system includes one or more relays connected between the indoor unit and the outdoor unit that are configured to conduct electrical current from the indoor unit to the outdoor unit to operate the compressor in the second stage in response to the dehumidification signal to reduce the relative humidity in the conditioned space.

Some embodiments disclosed herein are directed to an air conditioning system including a thermostat configured to monitor a temperature and a relative humidity of a conditioned space. The thermostat includes a first terminal associated with a first cooling demand based on the temperature, a second terminal associated with a second cooling demand based on the temperature, the second cooling demand being greater than the first cooling demand, and a third terminal associated with the relative humidity. In addition, the air conditioning system includes a first conditioning unit comprising a first heat exchanger and a blower configured to generate an airflow past the first heat exchanger in at least a first blower speed, a second blower speed, and a third blower speed, the first blower speed being less than the second blower speed, and the second blower speed being less than the third blower speed. Further, the air conditioning system includes a second conditioning unit comprising a second heat exchanger and a compressor configured to circulate a refrigerant between the first heat exchanger and the second heat exchanger, the compressor having a first speed and a second speed, the first speed being less than the second speed. Still further, the air conditioning system includes wiring coupling the thermostat to the first conditioning unit and the second conditioning unit such that: when only the first terminal of the first, second, and third terminals are active on the thermostat, the blower operates at the second blower speed and the compressor operates at the first speed; when only the first and second terminals of the first, second, and third terminals on the thermostat are active, the blower operates at the third blower speed and the compressor operates at the second speed; and when only the first and third terminals of the first, second, and third terminals are active, the blower operates at the first blower speed and the compressor operates at the second speed.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

The relative humidity of a conditioned space may be a driving factor in the operation and control of a climate control system. Effective control of the relative humidity in a conditioned space may involve the coordinated control of multiple components of the climate control system. For instance, in the case of a climate control system that is configured to circulate a refrigerant to condition the air of a conditioned space, dehumidification may be achieved by controlling a temperature of an evaporator coil for cooling the airflow provided to the conditioned space. The temperature of the evaporator coil may in turn be affected by the operation of multiple other components of the climate control system (e.g., such as a speed of an indoor blower generating the airflow over the evaporator and/or the operating speed of a compressor for circulating the refrigerant). However, many existing climate control systems may lack the additional sensing, communications, and control systems for such precise, coordinated control of these separate components for optimal dehumidification operations. Moreover, complete replacement of a climate control system (or a major component thereof) for newer, more sophisticated models (which may have additional sensing, communication, and control systems for enhanced and coordinated dehumidification operations) may be cost prohibitive for many consumers.

Accordingly, embodiments disclosed herein include systems and methods for enhancing the dehumidification functionality of an existing climate control system that may lack additional sensing, communication, and/or control systems that are typically associated with so-called "communicating" climate control system models. In some embodiments, the systems and methods may include one or more electrical switches that may be electrically coupled to an existing two-stage climate control system that may allow for coordinated, automatic adjustments of multiple components of the climate control system to improve dehumidification functionality of the climate control system during operations. Thus, through use of the embodiments disclosed herein, an existing climate control system may enjoy improved dehumidification functionality via a bolt-on solution without additional modifications of other major components, thereby providing an economically feasible improvement for a greater number of consumers.

Figure 1:
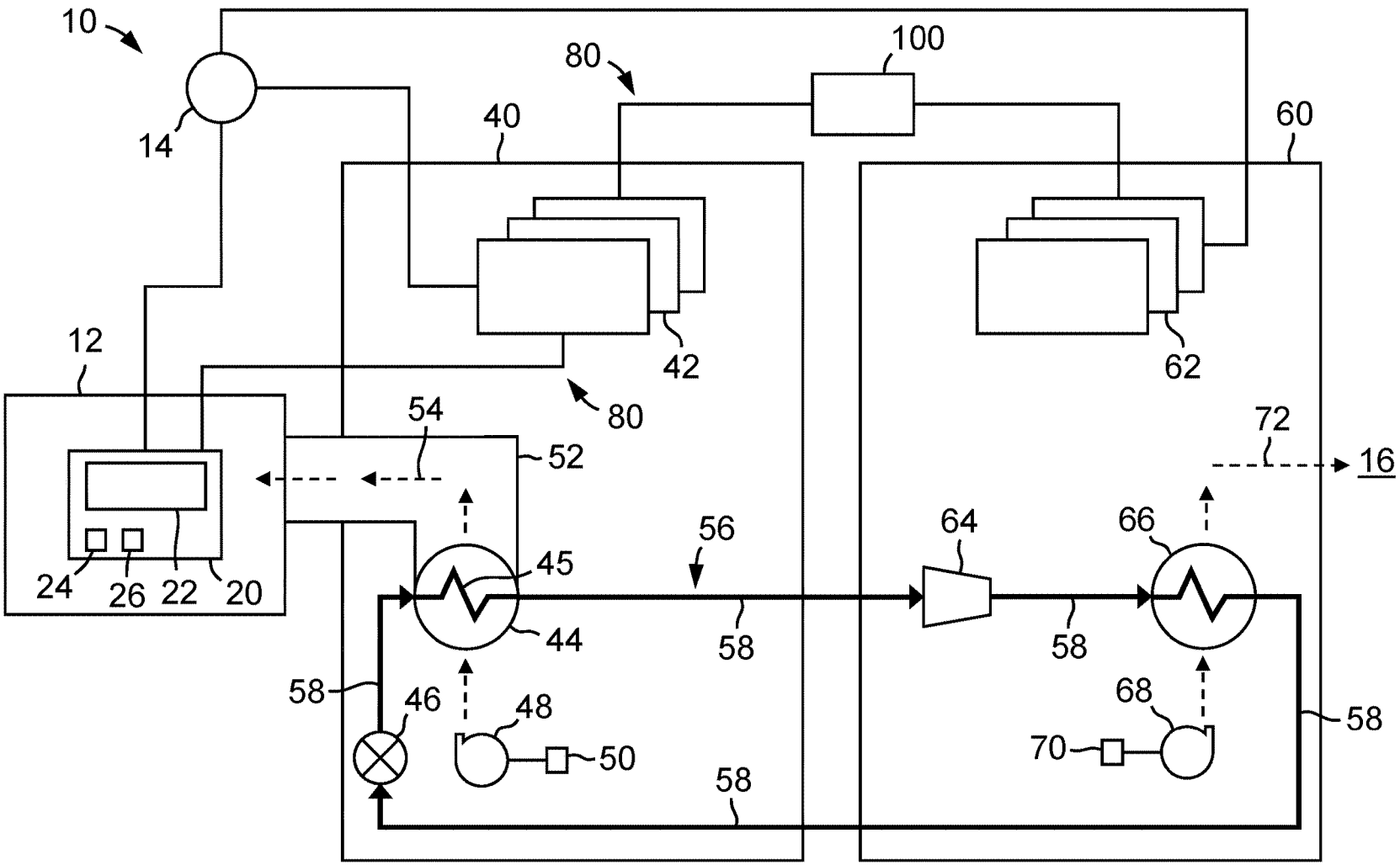
FIG. 1 is a schematic diagram of a climate control system according to some embodiments disclosed herein.

Referring to FIG. 1, a climate control system 10 according to some embodiments disclosed herein is shown. Generally speaking, the climate control system 10 may be configured to exchange heat between a conditioned space 12 and an unconditioned ambient environment 16. The conditioned space 12 may be the interior of a home, office, store, shipping container, refrigerator, freezer, or other interior space. In order to simplify the description herein, the conditioned space 12 may be described as being an interior or indoor space of a residential home, so that the conditioned space 12 may be referred to as an "indoor space." In addition, the ambient environment 16 may be an outdoor environment that is outside of (and that may surround) the conditioned space 12.

The climate control system 10 generally includes a first heat exchanger 44, a refrigerant compressor 64, a second heat exchanger 66, and a modulating valve 46. The refrigerant compressor 64 may be more simply referred to herein as a "compressor." A plurality of refrigerant lines 58 are coupled to and interconnect the first heat exchanger 44, compressor 64, second heat exchanger 66, and modulating valve 46 to thereby define a refrigerant circuit 56 for the climate control system 10.

In some embodiments, the first heat exchanger 44 and modulating valve 46 may be embodied as an at least partially integrated first conditioning unit 40. In addition, in some embodiments, the compressor 64 and second heat exchanger 66 may be embodied as an at least partially integrated second conditioning unit 60. In some embodiments, the first conditioning unit 40 may be positioned in any suitable indoor space that may or may not be the same (or connected to) the conditioned space 12. For instance, the first conditioning unit 40 may be positioned in an attic, storage room, basement, building, enclosure, etc. that is proximate to, connected to, or at least partially integrated (or inside of) the conditioned space 12 (e.g., when the conditioned space is the interior of a home as previously described). Conversely, the second conditioning unit 60 may be positioned in the ambient environment 16, which (as previously described) may be outdoors. Thus, the first conditioning unit 40 may be referred to herein as an "indoor unit" and the second conditioning unit 60 may be referred to herein as an "outdoor unit." However, these example positions of units 40, 60 are not intended to limit a particular location of either of the units 40, 60 in various embodiments. For example, in some embodiments, the indoor unit 40 and the outdoor unit 60 may be at least partially integrated with one another and co-located in an outdoor environment (e.g., such as in the case of a so-called "packaged unit" climate control system).

During operation, a refrigerant (or other heat transfer fluid) is circulated along the fluid circuit 56 between the units 40, 60 to exchange heat between the conditioned space 12 and the ambient environment 16. Specifically, the compressor 64 may compress the refrigerant and output the compressed refrigerant to the second heat exchanger 66. The second heat exchanger 66 is configured to facilitate heat transfer between the refrigerant and the ambient environment 16. Because the climate control system 10 is configured as an air conditioner for cooling the conditioned space 12, the second heat exchanger 66 shown in FIG. 1 is configured to transfer heat from the refrigerant to the ambient environment 16, and thereby condense (or substantially condense) the refrigerant from a vapor into a liquid. Thus, the second heat exchanger 66 may be referred to herein as a "condenser." A fan or blower 68 may generate an airflow 72 that is directed through, around, onto, etc. the second heat exchanger 66 so that heat may be transferred from the refrigerant to the airflow 72, which in turn flows into the ambient environment 16.

The liquid (or substantially liquid) refrigerant is then directed to the indoor unit 40. Within the indoor unit 40, the refrigerant is first directed through the modulating valve 46, whereby it is controllably expanded and reduced in temperature. The expanded, cold refrigerant is then directed through the first heat exchanger 44. The first heat exchanger 44 is configured to facilitate heat exchange between the refrigerant and an airflow 54 generated by a blower or fan 48. Specifically, the first heat exchanger 44 channels the cold, expanded refrigerant through a coil 45 that is exposed to the airflow 54 so that heat is transferred from the airflow 54 to the refrigerant. As a result, the temperature of the airflow 54 is reduced and water vapor that is entrained in the airflow 54 may at least partially condense onto the relatively cold coil 45, to thereby also at least partially reduce a relative humidity of the airflow 54. The cooled and partially dried airflow 54 may then be emitted back to the conditioned space 12 via suitable ducting 52. As the refrigerant flows through the coil 45 of the first heat exchanger 44, the heat from the airflow 54 causes the refrigerant to change phase from a liquid to a vapor. Thus, the first heat exchanger 44 may be referred to herein as an "evaporator." The vaporized (or substantially vaporized) refrigerant is then directed back to the outdoor unit 60, and particularly the compressor 64 to restart the cycle previously described above.

It should be appreciated that in some embodiments, the climate control system 10 may be configured as a heat pump. In these embodiments, the refrigerant circuit 56 may include an additional expansion valve in the outdoor unit 60 and may include a reversing valve that allows for selective reversal in the flow direction of refrigerant through the refrigerant circuit 56 during operations. When the reversing valve is actuated to reverse the flow of refrigerant from that described above, the first heat exchanger 44 may condense the refrigerant and the second heat exchanger 66 may vaporize the refrigerant so that heat is generally transferred from the ambient environment 16 to the conditioned space 12. Thus, while climate control system 10 is described as an air-conditioning system, the embodiments disclosed herein may be utilized on examples of a climate control system that are configured as a heat pump.

The operations of the climate control system 10 may be at least partially directed by a thermostat 20 positioned in the conditioned space 12. The thermostat 20 may comprise a user interface for the climate control system 10 that allows a user (e.g., an occupant of the conditioned space 12) to make operational selections for the climate control system 10. Specifically, as will be described in more detail herein, a user may interact with the thermostat 20 to establish one or more environmental setpoints that may dictate an operational performance of the climate control system 10 during operations.

The thermostat 20 may include one or more user interface devices 22 such as one or more electronic displays, keypads, buttons, switches, or combinations thereof. For instance, in some embodiments, the one or more user interface devices 22 may comprise a touch sensitive electronic display that may both present information to a user as well as receive inputs from the user during operations. Still other user interface devices 22 (or combinations thereof) are contemplated in other embodiments.

In addition, the thermostat 20 may include (or may be coupled to) one or more environmental sensors 24, 26 that are configured to sense an environmental condition (or parameter indicative thereof) for purposes of operating the climate control system 10 and/or informing the user. For instance, the one or more environmental sensors 24, 26 may include a temperature sensor 24 and a humidity sensor 26. The temperature sensor 24 may comprise any suitable temperature sensing device or array (e.g., thermocouple, thermistor, thermometer, etc.) that is configured to detect or determine the temperature (or value indicative thereof) of the conditioned space 12 during operations. Likewise, the humidity sensor 26 may comprise any suitable sensing device or array (e.g., capacity humidity sensor, resistive humidity sensor, thermal conductivity humidity sensors, etc.) that is configured to detect or determine a humidity, such as a relative humidity, (or value indicative thereof) of the conditioned space 12 during operations.

The thermostat 20 may include or be coupled to suitable circuitry and/or devices that are configured to make determinations regarding the operational parameters of the climate control system 10 based at least in part on one or more inputs (e.g., user inputs, outputs from the environmental sensors 24, 26, etc.). For instance, the thermostat 20 may include (or be coupled to) a controller or other computing system that may include a processor that is configured to make determinations such as selecting one or more operating modes for the climate control system and outputting suitable signal(s) for causing the components (e.g., indoor unit 40, outdoor unit 60, or components thereof) to operate according to the selected operating mode. In some embodiments, the thermostat 20 may lack a processor, but may include (or be couped to) suitable circuitry that may output suitable electrical signals for operating the climate control system in a plurality of operating modes based at least in part on the one or more inputs.

The thermostat 20 may be electrically coupled to one or more other components of the climate control system 10 via wiring 80 so that the thermostat 20 may output signals to activate, direct, actuate, control, deactivate, etc. the climate control system 10 (or component(s) thereof) during operations. For instance, the thermostat 20 may be electrically coupled to one or more circuit boards 42, 62 of the indoor unit 40 and outdoor unit 60 via wiring 80 so that signals (e.g., electrical signals, such as a 24 volt electrical signal) may be conducted between the thermostat 20, indoor unit 40 (via circuit board(s) 42), and outdoor unit 60 (via circuit board(s) 62) during operations. The wiring 80 may conduct signals emitted from the thermostat 20 to the circuit board(s) 62 of the outdoor unit 60 via the indoor unit 40 (e.g., so that the outdoor unit 60 and indoor unit 60 are electrically coupled in series to the thermostat 20 via wiring 80).

The circuit board(s) 42 and the circuit board(s) 62 may comprise one or more collections of circuits and/or other electronic devices for controlling one or more components of the indoor unit 40 and outdoor unit 60, respectively. The circuit board(s) 42 may be electrically coupled to, the motor 50 of blower 48, the modulating valve 46, and/or other components of the indoor unit 40. Likewise, the circuit board(s) 62 may be electrically coupled to the compressor 64 (e.g., such as the motor or driver—not shown—that is configured to driver operation of the compressor 64), the motor 70 of blower 68, and/or other components of the outdoor unit 60.

During operations, the thermostat 20 may monitor environmental conditions (e.g., temperature and relative humidity) in the conditioned space 12 via the sensors 24, 26. If one or both of the temperature or relative humidity rise above an established set point or threshold (which may be selected by a user or otherwise set by the thermostat 20), the thermostat 20 may output appropriate electrical signals via the wiring 80 to activate the components of the climate control system 10, via the circuit board(s) 42, 62, namely compressor 64, blowers 48, 68, etc. to drive the environmental conditions back toward their set points. Likewise, if one or both of the temperature or relative humidity have fallen to or below their threshold values, the thermostat 20 may again output appropriate electrical signals via the wiring 80 and circuit board(s) 42, 62 to deactivate one or more components of the climate control system 10.

The thermostat 20 and circuit board(s) 42, 62 of the units 40, 60, respectively, may receive electrical power from a suitable power source 14, which may comprise a local power source (e.g., local utility power source) either directly or via suitable transformer(s) or other devices and components.

The thermostat 20 and circuit board(s) 42, 62 of units 40, 60, respectively, may be electrically coupled to power source 14 in series, in parallel, or in some combination thereof.

Referring still to FIG. 1, the climate control system 10 may comprise a so-called "multi-stage" system in that one or more components of the climate control system 10 may operate at a plurality of stages or levels to adjust a cooling capacity of the climate control system 10 depending on one or more factors (e.g., such as the cooling demand in the conditioned space 12). For example, the flow rates of the refrigerant and airflows 54, 72 may be adjusted (e.g., via the operating speeds of the compressor 64 and blowers 48, 68, respectively) between a plurality of pre-selected values to provide a different cooling capacity for the climate control system 10 during operations.

In the particular example embodiment of FIG. 1, the climate control system 10 may be a two-stage air conditioning system that is configured to operate at a first or low stage to provide a relatively lower cooling capacity for the conditioned space 12, and a second or high stage to provide a relatively higher cooling capacity for the conditioned space 12. In the low stage, the compressor 64 may be operated at a first or low compressor speed, and in the high stage, the compressor 64 may be operated at a second or high compressor speed, the high compressor speed (or more simply "high speed") being greater than the low compressor speed (or more simply "low speed"). Likewise, in the low stage, the blower 48 may be operated (via motor 50) in a first or low blower speed, and in the high stage, the blower 48 may be operated in a second or high blower speed, the high blower speed (or more simply "high speed") being greater than the low blower speed (or more simply "low speed"). In addition, the blower 68 may also be operated in low and high speeds in the low and high stages, respectively, to ensure a sufficient rate of heat transfer from the refrigerant to the ambient environment 16 during operations.

The thermostat 20 may selectively operate the climate control system 10 in the low stage or the high stage based at least in part on the environmental conditions in the conditioned space 12. For instance, the thermostat 20 may operate the climate control system 10 in the low stage or the high stage based at least in part on a difference between a temperature setpoint (or threshold) and a current temperature of the conditioned space 12 (as determined via the temperature sensor 24), which may correspond to a current cooling demand for the conditioned space 12. Thus, if a cooling demand of the conditioned space 12 is large (e.g., indicated by a difference between the setpoint temperature and current temperature in the conditioned space 12 being above a threshold), then the thermostat 20 may output suitable signal(s) to indoor unit 40 and outdoor unit 60 via wiring 80 to operate the climate control system 10 in the high stage. Conversely, if a cooling demand of the conditioned space is small (e.g., indicated by a difference between the setpoint temperature and current temperature in the conditioned space 12 being at or below a threshold), then the thermostat 20 may output suitable signal(s) to indoor unit 40 and outdoor unit 60 via wiring 80 to operate the climate control system 10 in the low stage.

If, during operations in either the low stage or the high stage, the relative humidity in the conditioned space 12 (e.g., as determined or detected via the humidity sensor 26) rises above a setpoint or threshold, the thermostat 20 may enter a dehumidification mode of operation in order to more aggressively lower a relative humidity within the conditioned space 12. Specifically, when operating in the dehumidification mode, the thermostat 20 may adjust an operating speed of the blower 48 (via motor 50) of indoor unit 40 to further lower the speed of the airflow 54. For instance, in the dehumidification mode, the blower 48 may be operated at a third or dehumidification blower speed that is lower than both the low blower speed and the high blower speed associated with the low stage and high stage operation, respectively. For instance, in some embodiments, the dehumidification blower speed may be about 20% slower than the low blower speed. In some embodiments, during the dehumidification mode, the blower 48 of indoor unit 40 may be operated at the low speed associated with the low stage operation of the climate control system 10. Without being limited to this or any other theory, lowering a speed of the airflow 54 across the coil 45 of first heat exchanger 44 may reduce a rate of heat transfer between the refrigerant and the airflow 54 so that an operating temperature of the coil 45 may decrease. The reduced temperature of the coil 45 may condense a higher volume of water vapor out of the airflow 54 per unit time, so that a relative humidity of the conditioned space 12 may be decreased more aggressively.

However, while existing multi-stage climate control systems may include a dehumidification mode for the blower 48 of the indoor unit 40, such climate control systems may lack additional controls for also modulating the speed of the compressor 64 in concert with speed changes for the blower 48 to thereby exert additional influence and control over the temperature of the coil 45 for aggressively reducing the relative humidity of the conditioned space 12. Thus, the climate control system 10 according to the embodiments disclosed herein includes one or more electrical switches 100 that are electrically coupled to the indoor unit 40 and outdoor unit 60 via the wiring 80 that is configured to selectively adjust an operating speed of the compressor 64 based on an activation of the dehumidification mode at the indoor unit 40 (e.g., via thermostat 20). As described in more detail herein, the one or more electrical switches 100 may be installed onto the climate control system 10 (e.g., via a retrofit operation) without other modifications or replacements (outside of some minor alterations to the wiring 80 or wiring connections between the indoor unit 40 and outdoor unit 60) to existing components of climate control system 10 (e.g., such as the thermostat 20, indoor unit 40, outdoor unit 60, or components thereof), so that the one or more switches 100 may provide a cost-efficient enhancement to the dehumidification functionality of climate control system 10. Further aspects of the one or more electrical switches 100 and wiring 80 are described in more detail herein.

Figure 2:
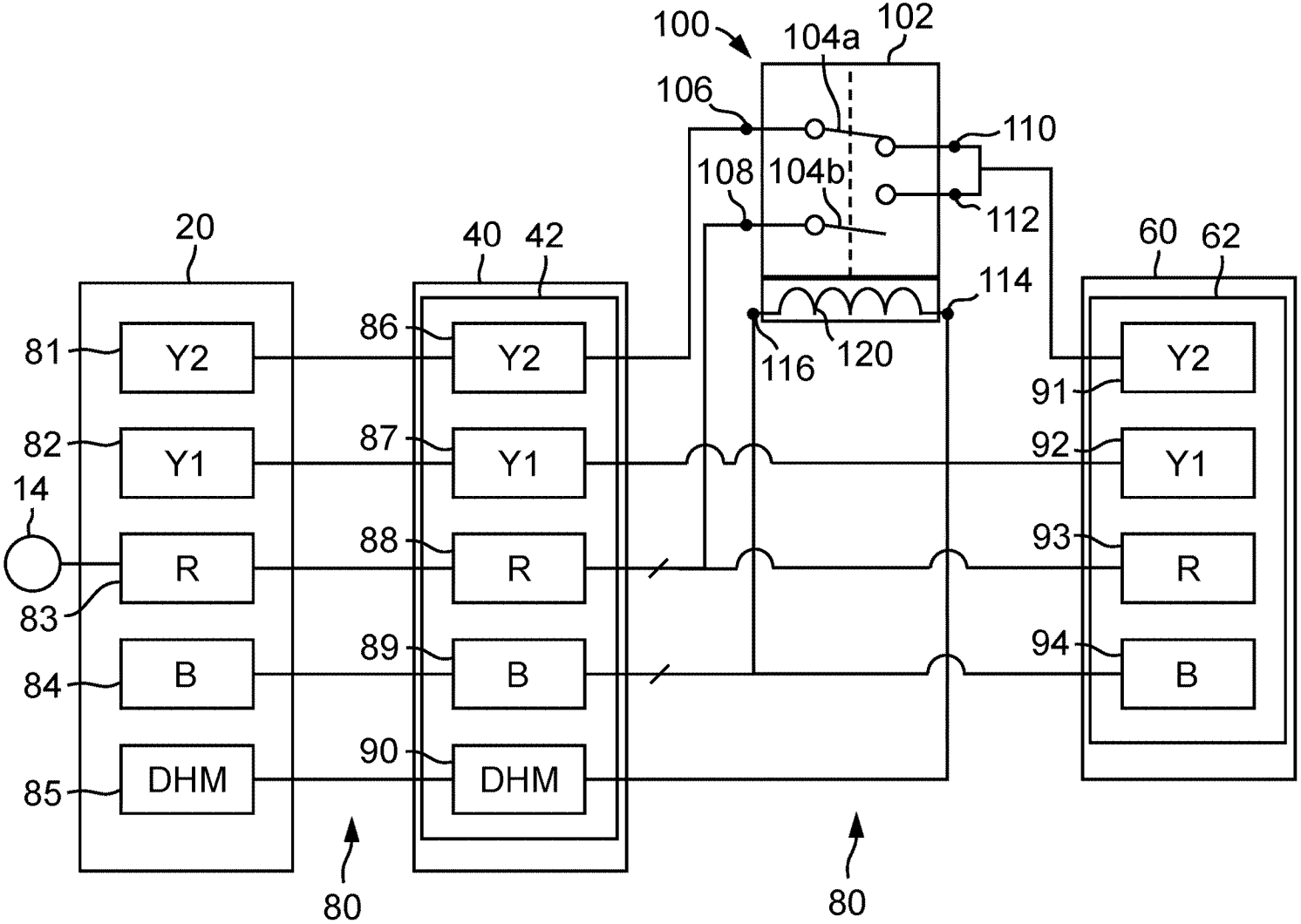
FIG. 2 is a wiring diagram of the climate control system of FIG. 1 illustrating an electrical switch in a first position according to some embodiments disclosed herein.
Figure 3:
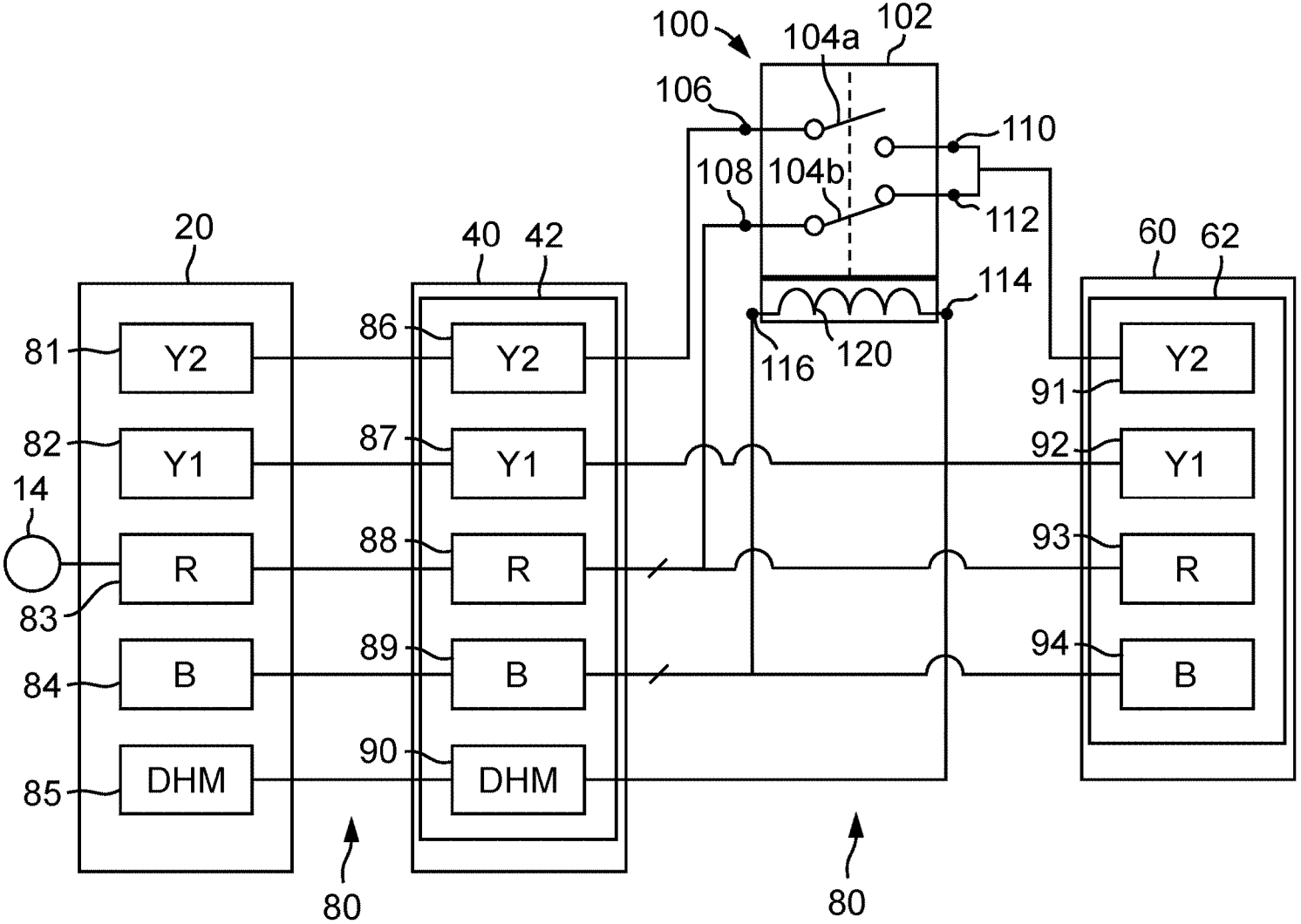
FIG. 3 is a wiring diagram of the climate control system of FIG. 1, illustrating the electric switch in a second position according to some embodiments disclosed herein.

FIGS. 2 and 3 show wiring diagrams of the climate control system 10 according to some embodiments. The wiring diagrams of FIGS. 2 and 3 illustrate the one or more electrical switches 100 in a first position (FIG. 2) and a second position (FIG. 3) for selectively changing a speed of the compressor to enhance the dehumidification operation of the climate control system 10 during operations. As will be described in more detail herein, when the one or more electrical switches 100 are in a first position of FIG. 2, the speed of the compressor 64 (FIG. 1) may be selectively switched between the low speed and high speed according to the cooling demand of the conditioned space 12 (FIG. 1) as previously described. Conversely, when the one or more electrical switches 100 are in the second position of FIG. 3, the speed of the compressor 64 may be increased to (or maintained in) the high speed so as to further decrease a temperature (or maintain a low temperature) of the coil 45 of the first heat exchanger 44 (FIG. 1) and thereby enhance dehumidification operations as previously described.

As shown in FIG. 2, the thermostat 20 has a plurality of terminals, including a high stage terminal 81, a low stage terminal 82, an electrical power terminal 83, a common or neutral terminal 84, and a dehumidification terminal 85. Likewise, the one or more circuit boards 42 of the indoor unit 40 may include a high stage terminal 86, a low stage terminal 87, an electrical power terminal 88, a common terminal 89, and a dehumidification terminal 90. Further, the one or more circuit boards 62 of the outdoor unit 60 may include a high stage terminal 91, a low stage terminal 92, an electrical power terminal 93, and a common terminal 94. The thermostat 20, circuit board(s) 42 of indoor unit 40, and the circuit board(s) 62 of outdoor unit 60 may have additional terminals to those shown in FIGS. 2 and 3 and described herein, and the representation of FIGS. 2 and 3 has been simplified to promote clarity and conciseness herein.

The terminals 81-94 may have various labels or symbols that may be used for identification during installation or maintenance activities. While a variety of different symbolic conventions may be used, in the embodiment illustrated in FIGS. 2 and 3, the dehumidification terminals 85, 90 may be identified (e.g., labeled) as "DHM," the common terminals 84, 89, 84 may be identified (e.g., labeled) as "B," the electrical power terminals 83, 88, 93 may be identified (e.g., labeled) as "R," the low stage terminals 82, 87, 92 may be identified (e.g., labeled) as "Y1," and the high stage terminals 81, 86, 91 may be identified (e.g., labeled) as "Y2." Some of these labels, such as the labels B, R, Y1, Y2 may correspond with a color of the shielding or insulation of the corresponding wires of wiring 80. For instance, the wires connecting the "B" terminals 84, 89, 94 may be black in color (or blue in some instances), the wires connecting the "R" terminals 83, 88, 93 may be red in color, and the "Y1" terminal 82, 87, 92 and "Y2" terminals 81, 86, 91 may be yellow in color. However, other color and/or symbolic conventions are contemplated herein for the terminals 81-94.

The high stage terminal 81, the low stage terminal 82, the electrical power terminal 83, the common terminal 84, and the dehumidification terminal 85 of the thermostat 20 may be electrically coupled, via wiring 80, to the high stage terminal 86, the low stage terminal 87, the electrical power terminal 88, the common terminal 89, and the dehumidification terminal 90, respectively, of the indoor unit 40. Likewise, the low stage terminal 87, the electrical power terminal 88, and common terminal 89 of the indoor unit 40 may be electrically coupled, via the wiring 80, to the low stage terminal 92, the electrical power terminal 93, and the common terminal 94, respectively, of the outdoor unit 60. Further, the one or more electrical switches 100 may be electrically coupled to the high stage terminals 86, 91 of the indoor unit 40 and outdoor unit 60, respectively, and may be electrically coupled to the electrical power terminal 88, common terminal 89, and dehumidification terminal 90 of the indoor unit 40.

The high stage terminals 81, 86, 91 of thermostat 20, indoor unit 40, and outdoor unit 60, respectively, are associated with operating the compressor 64 (FIG. 1) at the high compressor speed associated with the high-stage operation of climate control system 10. Likewise, the low stage terminals 82, 87, 92 of thermostat 20, indoor unit 40, and outdoor unit 60, respectively, are associated with operation of compressor 64 (FIG. 1) at low compressor speed associated with the low-stage operation of climate control system 10.

The electrical power terminals 83, 88, 93 of thermostat 20, indoor unit 40, and outdoor unit 60, respectively, are all electrically coupled to the electrical power source 14. In particular, in some embodiments, the terminals 83, 88, 93 are connected to electrical power source 14 in series; however, other coupling arrangements (e.g., in parallel) are contemplated as previously described. Also, the common terminals 84, 89, 94 are all electrically coupled to one another to at least partially define a common or neutral electrical plane for the climate control system 10. In some embodiments, the common terminals 84, 89, 94 may all be electrically coupled to an electrical ground.

The dehumidification terminals 85, 90 are associated with the dehumidification mode of the climate control system 10 (FIG. 1). Specifically, when thermostat 20 determines that the relative humidity of the conditioned space 12 has risen above a threshold or setpoint (e.g., via humidity sensor 26 as previously described—FIG. 1), the thermostat 20 may output a dehumidification signal via the terminal 85 that is connected to the terminal 90 via wiring 80 to cause the indoor unit 40 reduce a speed of the blower 48 (e.g., to the dehumidification speed) to reduce a temperature of the coil 45 of first heat exchanger 44 as previously described. The thermostat 20 may output the dehumidification signal via the terminal 85 by altering an electrical energization of the terminal 85, and thus in turn altering the electrical energization of the terminal 90. Thus, the dehumidification signal output by the thermostat 20 may include energizing the terminal 85, changing an electrical energization of the terminal 85, ceasing an electrical energization of the terminal 85, etc. Accordingly, as used herein, "outputting a signal" may include any suitable adjustment in the electrical energization of a terminal (e.g., such as terminal 85), such as those noted above.

In some embodiments, the one or more electrical switches 100 may comprise a single relay switch 102 (or more simply "relay"); however, it should be noted that a plurality of switches (e.g., relay switches) may be utilized to provide the same or similar functionality in other embodiments. For instance, the relay 102 may comprise a double throw (DT) relay that includes a one or more switching elements **104*a*, 104*b* coupled between two or more input terminals and one or more output terminals. Specifically, in the embodiment illustrated in FIGS. 2 and 3, the relay 102 has a pair of input terminals 106, 108 and a pair of output terminals 110, 112. The relay 102 may include fewer or additional terminals to those illustrated in FIGS. 2 and 3, in some embodiments. A first input terminal 106 of the relay 102 is electrically coupled to the high stage terminal 86 of the indoor unit 40, and a second input terminal 108 of the relay 102 is electrically coupled to the electrical power terminal 108 of the indoor unit 40. A first output terminal 110 of the relay 102 and a second output terminal 112 of the relay 102 are both electrically coupled to the high stage terminal 91 of outdoor unit 60**.

In the embodiment illustrated in FIGS. 2 and 3, the one or more switching elements **104*a*, 104*b* may comprise two switching elements—namely a first switching element 104*a* and a second switching element 104*b*. Thus, the relay 102** may comprise a "double pole" DT (or DPDT) relay.

When the relay 102 is in the first position of FIG. 2, a first switching element **104*a* is actuated to electrically couple the first input terminal 106 to the first output terminal 110, and a second switching element 104*b* is actuated to electrically decouple the second input terminal 108 from the second output terminal 112. Conversely, when the relay 102 is in the second position of FIG. 3, the first switching element 104*a* is actuated to electrically decouple the first input terminal 106 from the first output terminal 110, and the second switching element 104***b* is actuated to electrically couple the second input terminal 108 to the second output terminal 112.

Thus, as shown in FIG. 2, when the relay 102 is in the first position the high stage terminal 86 of indoor unit 40 is electrically coupled to the high stage terminal 91 of outdoor unit 60 via the terminals 106, 110 and first switching element 104*a*, and the electrical power terminal 87 is electrically decoupled from the high stage terminal 91 of outdoor unit 60 via the disconnected second switching element 104*b*. As a result, with relay 102 in the first position, the high stage terminal 91 of outdoor unit 60 may be energized via the high stage terminal 81 of thermostat 20 and the high stage terminal 86 of indoor unit 40. Specifically, the first position (FIG. 2) of the relay 102 may be associated with so-called normal operation of the climate control system 10 (that is, normal operations that are separate and distinct from dehumidification mode). Thus, in the first position (FIG. 2), the thermostat 20 may selectively energize the terminal 91 via terminal 86 and relay 102 to increase the operating speed of the compressor 64 based on the cooling demand in the conditioned space 12 (FIG. 1) as previously described. Specifically, in the first position (FIG. 2), the thermostat 20 may activate the low stage terminal 82 (e.g., via energizing the low stage terminal 82 with electric current), which in turn may activate the low stage terminals 87, 92 of indoor unit 40 and outdoor unit 60, respectively. If the high stage terminals 81, 86, 91 are not also activated (e.g., energized), the outdoor unit 60 may respond by operating the compressor 64 (FIG. 1) in the low stage (e.g., at the low speed). If, on the other hand, the thermostat 20 also activates the high stage terminal 81 (e.g., again via energizing the terminal 81 is electric current), the high stage terminals 86, 91 of units 40, 60 may also be activated (e.g., via relay 102 in the first position of FIG. 2) so that the compressor 64 is instead operated in the high stage (e.g., at the high speed). Regardless of the stage of operation for the climate control system 10, in some embodiments, if the low stage terminal 82 of thermostat 20 is deactivated (e.g., by de-energizing the terminal 82) the compressor 64 may be deactivated (even if the high stage terminal 81 remains or is activated).

As shown in FIG. 3, when the relay 102 is in the second position, the high stage terminal 86 of indoor unit 40 is electrically decoupled from the high stage terminal 91 of outdoor unit 60 via the disconnection with the first switching element 104*a*, and the electrical power terminal 87 is electrically coupled to the high stage terminal 91 of outdoor unit 60 via the second switching element 104*b*. As a result, with relay 102 in the second position, the high stage terminal 91 of outdoor unit 60 may be continuously energized by the electrical power source 14 via electrical power source terminals 83, 88 of thermostat 20 and indoor unit 40. Specifically, the second position (FIG. 3) of the relay 102 may be associated with dehumidification operations of the climate control system 10. Thus, in the second position (FIG. 3), the electrical power source 14 may energize the high stage terminal 91 on outdoor unit 60 to thereby increase the operating speed of the compressor 64 (FIG. 1) so as to further decrease a temperature of the coil 45 of first heat exchanger 44 (FIG. 1) to enhance dehumidification operations for the climate control system 10 as previously described. The electrical power source 14 may provide a continuous or constant supply of electrical current, so that if the relay 102 is actuated to the second position (FIG. 3) the high stage terminal 91 of outdoor unit 60 is electrically energized. Thus, if the relay 102 is actuated to the second position (FIG. 3) while the climate control system 10 was previously operating in the low stage, the speed of the compressor 64 is increased from the low speed to the high speed, and if the relay 102 is actuated to the second position (FIG. 3) while the climate control system 10 was operating in the high stage, the speed of the compressor 64 may be maintained at the high compressor speed. However, in some embodiments, even if the relay 102 is in the second position (FIG. 3), the deactivation (e.g., de-energization) of the low stage terminal 82 via the thermostat 20 may cause the compressor 64 to deactivate.

In some embodiments, the output terminals 110, 112 may be integrated into a single output terminal that is electrically coupled to the high stage terminal 91 of the outdoor unit 60. Moreover, in some of these embodiments, the relay 102 having the single, integrated output terminal may include a single switching element (e.g., switching elements 104*a*, 104*b*) that is connected to the single output terminal and actuatable between a first position to electrically couple the single output terminal with the first input terminal 106 (e.g., corresponding to the first position of the relay 102 shown in FIG. 2) and a second position to electrically couple the single output terminal with the second input terminal 108 (e.g., corresponding to the second position of the relay 102 shown in FIG. 3). Thus, in some embodiments, the relay 102 may comprise a "single pole" DT (or SPDT) relay.

The relay 102 may be actuated between the first position (FIG. 2) and the second position (FIG. 3) via the dehumidification signal output by the thermostat 20 via dehumidification terminal 85. Specifically, the relay 102 may include an electromagnet 120 and a pair of corresponding power terminals 114, 116 electrically coupled to the electromagnet 120. When the electromagnet 120 is energized with electric current, a magnetic field is generated in the relay 102 that is configured to actuate the switching elements 104*a*, 104*b*. Thus, adjusting an electrical energization (or ceasing or adjusting an electrical energization) of the electromagnet 120 may actuate the relay 102 between the first position (FIG. 2) and the second position (FIG. 3) during operations.

The first power terminal 114 may be electrically coupled to the dehumidification terminal 90 on the indoor unit 40, and the second power terminal 116 may be electrically coupled to the common terminal 89 on the indoor unit 40. Thus, during operations, when the thermostat 20 outputs the dehumidification signal via the dehumidification terminal 85, the electrical energization of the electromagnet 120 may change (via terminals 114, 116) so as to actuate the switching elements 104*a*, 104*b*. Specifically, as previously described, the dehumidification terminal 85 may be generally energized by the thermostat 20 during normal operations—that is, when the relative humidity of the conditioned space 12 (FIG. 1) is within the setpoint or threshold, and the dehumidification mode of climate control system 10 is not engaged. Thus, during normal (e.g., non-dehumidification) operation of the climate control system 10, the thermostat 20 may "deactivate" the dehumidification terminal 85 by energizing the dehumidification terminal 85 with electrical current and the electromagnet 120 of the relay 102 may, in turn, be energized with electric current via the electrical current conducted from dehumidification terminals 85 and 90 on thermostat 20 and indoor unit 40, respectively. The electric current supplied to the relay 102 may actuate the switching elements 104*a*, 104*b* to the first position (FIG. 2) via the magnetic field generated by electromagnet 120. However, when thermostat 20 switches from normal operation to the dehumidification mode (e.g., as a result of the relative humidity in the conditioned space 12 rising above a threshold or setpoint), the thermostat 20 may "energize" the dehumidification terminal 85 and therefore output the dehumidification signal, which results in a de-energization of the dehumidification terminal 90 of indoor unit 40, and de-energization of the electromagnet 120 of relay 102. As a result, the magnetic field in the relay 102 is altered (e.g., ceased) so that the switching elements 104*a*, 104*b* actuate from the first position (FIG. 2) to the second position (FIG. 3) to thereby electrically couple the high stage terminal 91 of outdoor unit 60 to the electrical power source 14 (via terminal 87) and thereby ensure operation of the compressor 64 at the high speed to support and enhance dehumidification operations with the climate control system 10 as previously described.

Thus, during a dehumidification mode operation, the thermostat 20 (upon determining or detecting that the relative humidity within the conditioned space 12 has risen above a setpoint or threshold) may activate the dehumidification mode by outputting the dehumidification signal via de-energization of dehumidification terminal 85 in some embodiments as previously described. The de-energization of dehumidification terminal 85 may cause a de-energization of the dehumidification terminal 90 of indoor unit 40, which may in turn react (e.g., via suitable circuitry, processor(s), etc.) by decreasing the speed of the blower 48 (e.g., to the dehumidification speed as previously described). In addition, the de-energization of the dehumidification terminal 90 may actuate the relay 102 to the second position (FIG. 3) so as to energize the high stage terminal 91 on outdoor unit 60 via the electrical power source 14 and thereby increase the speed of the compressor 64 to further enhance dehumidification operations as previously described.

Conversely, when thermostat 20 is operating the climate control system 10 in the normal mode of operation (e.g., not in dehumidification mode), the thermostat 20 may stop the dehumidification signal via energizing the dehumidification terminal 85 as previously described. The electric current may be conducted from the dehumidification terminal 85 to the dehumidification terminal 90 on indoor unit 40 so as to cause indoor unit 40 to operate the blower 48 at the speed associated with the current stage of operation (e.g., low-stage or high-stage) based on the cooling demand in the conditioned space 12 as previously described. In addition, energizing the dehumidification terminal 90 on indoor unit 40 may further energize the relay 102 via electromagnet 120 so as to actuate the switching elements 104*a*, 104*b* from the second position (FIG. 3) to the first position (FIG. 2) and thereby electrically couple the high stage terminal 91 of outdoor unit 60 to the high stage terminal 81 of thermostat 20 via high stage terminal 86 of indoor unit 40 so that the speed of the compressor 64 may also be controlled based on the operating stage of the climate control system 10 as previously described.

Thus, the relay 102 may enhance dehumidification operations of the climate control system 10 by utilizing the dehumidification signal output by the thermostat 20 to cause a coordinated increase in compressor 64 speed along with a decrease in blower 48 speed. Thus, an existing two-stage climate control system (e.g., climate control system 10) may be retrofit to include the relay 102 so as to enhance dehumidification operations without replacing or modifying one or more major components of the climate control system (e.g., such as thermostat 20, indoor unit 40, or outdoor unit 60). Accordingly, the relay switch 102 is a bolt-on solution that may provide enhanced functionality for the climate control system 10 with respect to dehumidification functionality.

Figure 4:
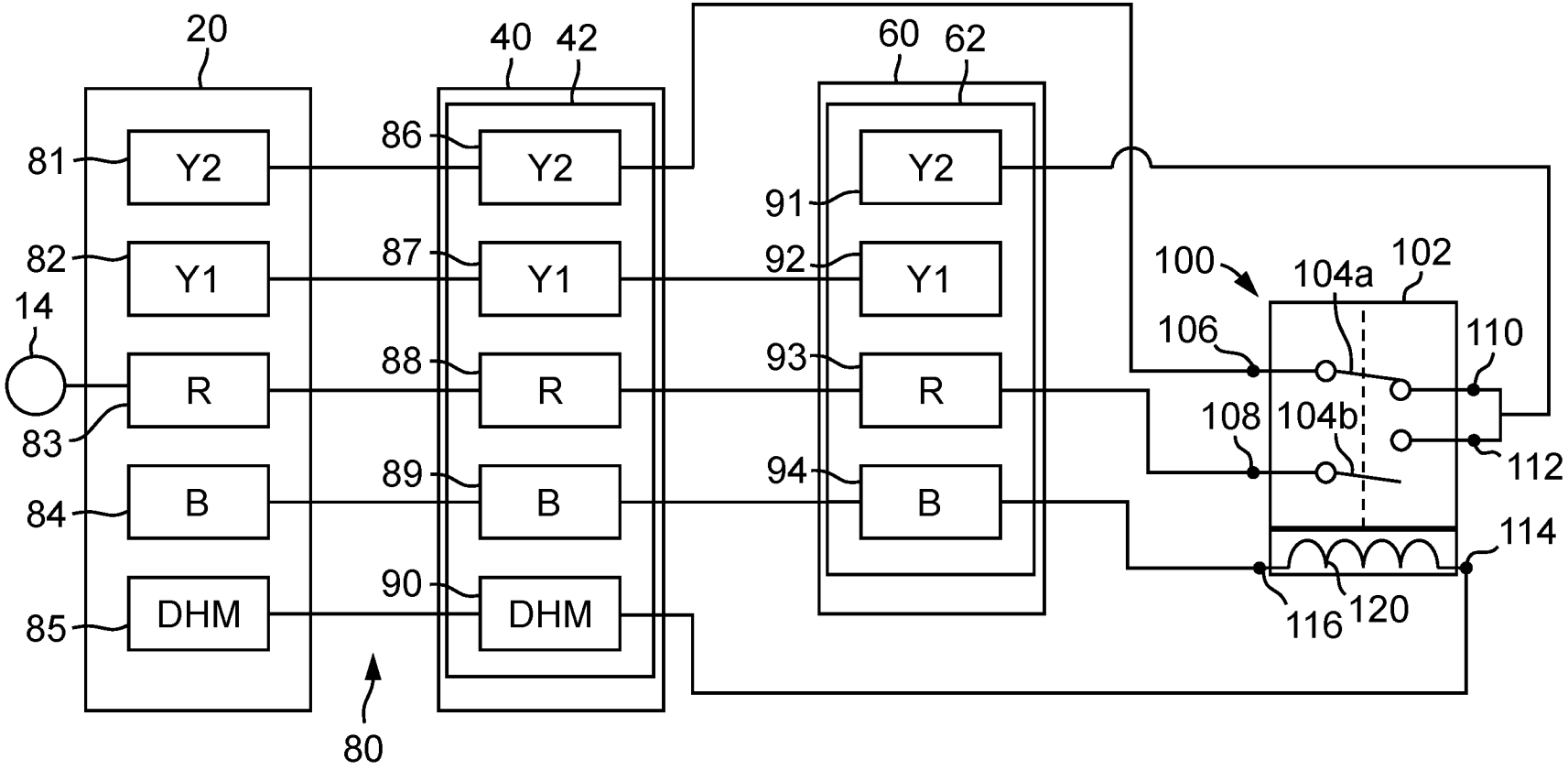
FIG. 4 is a wiring diagram of the climate control system of FIG. 1, illustrating the electric switch in a first position according to some embodiments disclosed herein.

In some embodiments, the relay 102 may be physically positioned on the indoor unit 40 or the outdoor unit 60. The positioning of the relay 102 may alter the precise routing of the wiring 80 between the indoor unit 40 and relay 102 and between the relay 102 and outdoor unit 60. The embodiment shown in FIGS. 2 and 3 illustrates the wiring 80 associated with positioning the relay 102 on or near the indoor unit 40. FIG. 4 shows an embodiment of the wiring 80 between the thermostat 20 and units 40, 60 when the relay 102 is positioned on or near the outdoor unit 60. For the embodiment of FIG. 4, the second input terminal 108 and second power terminal 116 may be electrically coupled to the electrical power terminal 93 and common terminal 94 of the outdoor unit 60 due to the positioning of the relay 102 on, in, or proximate to the outdoor unit 60 rather than the indoor unit 40. However, outside of these relatively minor differences in the wiring 80, the functionality of the relay 102 shown in FIG. 4 may be the same as that described above for the embodiment of FIGS. 2 and 3. It should be appreciated that the embodiments illustrated in FIGS. 2 and 3 may, in some circumstances, be implemented without adding additional wires to the wiring 80 between the units 40, 60, so that the alterations to the wiring 80 for installing the relay 102 may be limited to the wiring connections between the indoor unit 40, outdoor unit 60 and relay 102.

Figure 5:
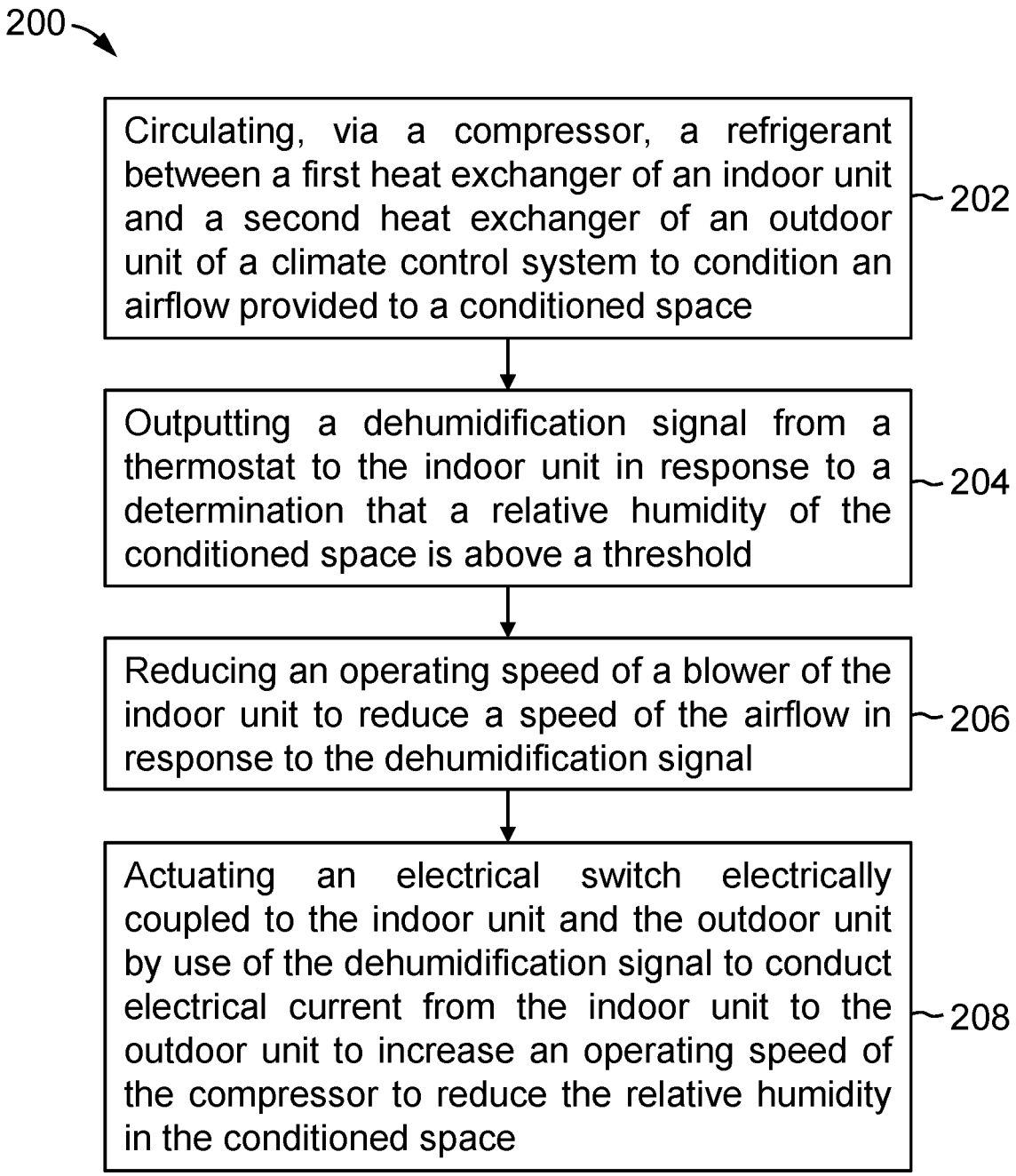
FIG. 5 is a block diagram of a method of operating a climate control system according to some embodiments disclosed herein.

Referring now to FIG. 5, a method 200 of operating a climate control system is shown according to some embodiments. The method 200 may be performed using embodiments of the climate control system 10 shown in FIGS. 1-4 and described herein. Thus, in describing the features of method 200, continuing reference may be made to the features shown in FIGS. 1-4. However, it should be appreciated that embodiments of method 200 may be performed using climate control systems that are different in at least some respect from the climate control system 10.

Initially, method 200 includes, at block 202, circulating, via a compressor, a refrigerant between a first heat exchanger of an indoor unit and a second heat exchanger of an outdoor unit of a climate control system to condition an airflow provided to a conditioned space. For instance, as previously described for climate control system 10, the refrigerant may be circulated through the refrigerant circuit 56 between the first heat exchanger 44 and the second heat exchanger 66 to cool the airflow 54 and therefore condition the conditioned space 12.

In addition, method 200 includes, at block 204, outputting a dehumidification signal from a thermostat to the indoor unit in response to a determination that a relative humidity of the conditioned space is above a threshold. Further, method 200 includes, at block 206, reducing an operating speed of a blower of the indoor unit to reduce a flowrate of the airflow in response to the dehumidification signal. For instance, as previously described for climate control system 10, the thermostat 20 may output a dehumidification signal by de-energizing the dehumidification terminal 85, which in turn de-energizes the dehumidification terminal 90 of the indoor unit 40. The de-energization of the dehumidification terminal 90 of the indoor unit 40 may cause the indoor unit 40 to decrease a speed of the blower 48 to therefore reduce a speed of the airflow 54.

Still further, method 200, at block 208, includes actuating an electrical switch electrically coupled to the indoor unit and the outdoor unit by use of the dehumidification signal to conduct electrical current from the indoor unit to the outdoor unit to increase an operating speed of the compressor to reduce the relative humidity in the conditioned space. For instance, as previously described for the climate control system 10, the relay 102 is actuated from a first position (FIG. 2) to a second position (FIG. 3) so as to electrically couple the electrical power source 14 to the high stage terminal 91 of the outdoor unit 60, via one or both of the electrical power terminals 88, 93 of the units 40, 60, so as to increase a speed (or maintain an increased speed) of the compressor 64 during a dehumidification operation.

Figure 6:
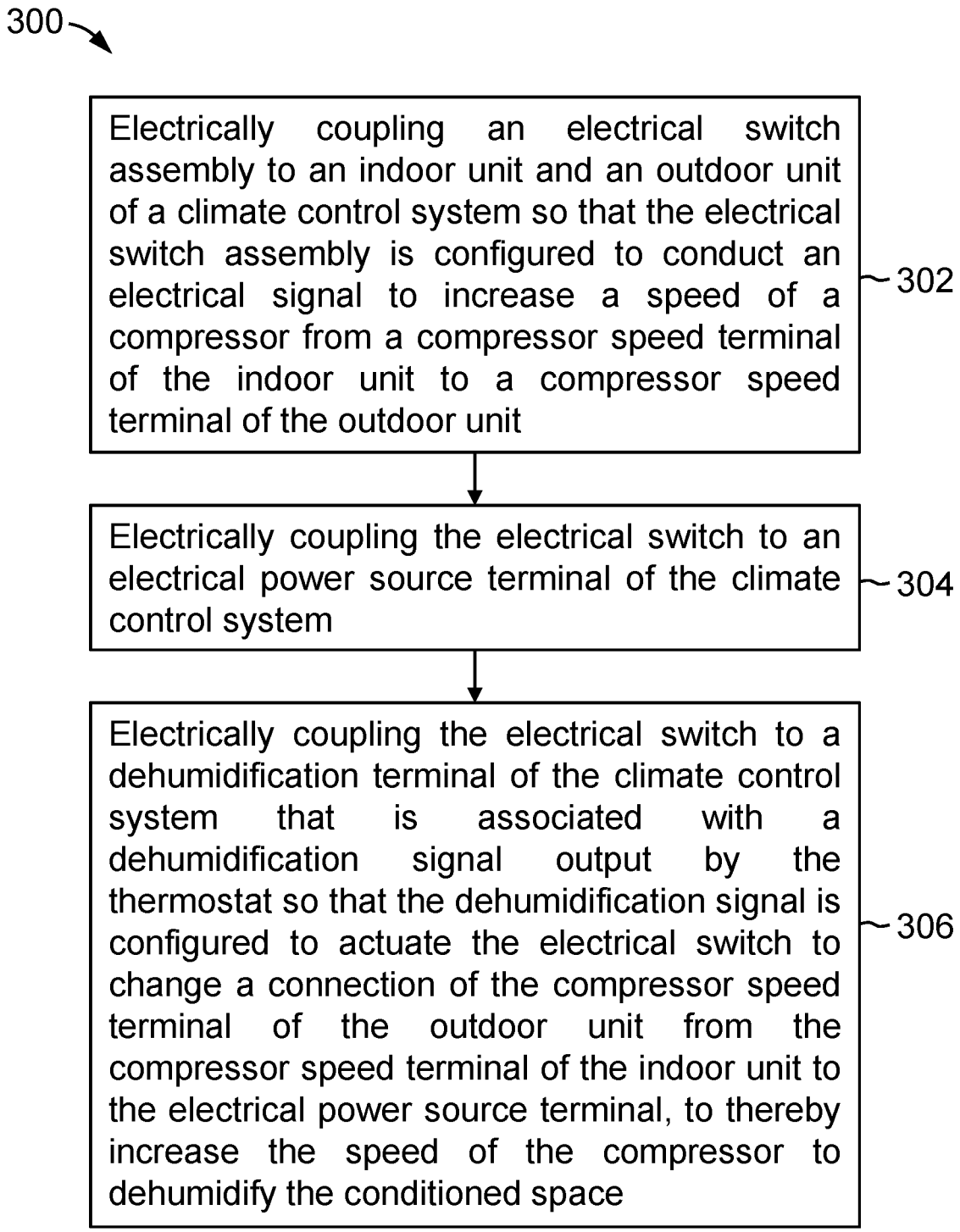
FIG. 6 is a block diagram of a method of retrofitting a climate control system according to some embodiments disclosed herein.

Referring now to FIG. 6, a method 300 of retrofitting a climate control system is shown according to some embodiments. The method 300 may be performed using embodiments of the climate control system 10 shown in FIGS. 1-4 and described herein. Thus, in describing the features of method 300, continuing reference may be made to the features shown in FIGS. 1-4. However, it should be appreciated that embodiments of method 300 may be performed using climate control systems that are different in at least some respect from the climate control system 10.

Initially, method 300 includes, at block 302, electrically coupling an electrical switch assembly to an indoor unit and an outdoor unit of a climate control system so that the electrical switch assembly is configured to conduct an electrical signal to increase a speed of a compressor from a compressor speed terminal of the indoor unit to a compressor speed terminal of the outdoor unit. For instance, as previously described, the relay 102 is electrically coupled to the circuit board(s) 42 of the indoor unit 40 and the circuit board(s) 62 of the outdoor unit 60 (FIGS. 2-4). The relay 102 may be physically positioned on, in, or proximate either the indoor unit 40, outdoor unit 60, or elsewhere (e.g., on, in, proximate thermostat 20), but is electrically coupled (e.g., via wiring 80) to the units 40, 60.

In addition, method 300 includes electrically coupling the electrical switch to an electrical power source terminal of the climate control system at block 304. For instance, as previously described, the relay 102 is electrically coupled to the electrical power source 14 via the electrical power terminal 88 of the indoor unit 40 (FIGS. 2-3) and/or the electrical power terminal 93 of outdoor unit 60 (FIG. 4). However, it should be appreciated that the relay 102 can be electrically coupled to the electrical power source 14 via other methods, such as, for example via the electrical power terminal 83 of thermostat 20, via wiring 80, etc.

Further, method 300 includes, at block 306, electrically coupling the electrical switch to a dehumidification terminal of the climate control system that is associated with a dehumidification signal output by the thermostat so that the dehumidification signal is configured to actuate the electrical switch to change a connection of the compressor speed terminal of the outdoor unit from the compressor speed terminal of the indoor unit to the electrical power source terminal, to thereby increase the speed of the compressor to dehumidify the conditioned space. For instance, as previously described, the relay 102 may be actuated via the dehumidification signal output from thermostat 20 from a first position (e.g., FIG. 1), to a second position (e.g., FIG. 2) so as to electrically couple the high stage terminal 91 on the outdoor unit 60 to the electrical power source 14 (e.g., via the electrical power terminal 88) and thereby increase (or maintain) a speed of the compressor 64 (FIG. 1) at the high-speed associated with the high-stage operation of the climate control system 10. Thus, as previously described, the electrical switch (e.g., relay 102) may ensure that compressor 64 is operated at a high speed to enhance and improve dehumidification operations.

In some embodiments, the indoor unit 40 of climate control system 10 may include suitable circuitry and/or controllers that are configured to energize the high stage terminal 91 of outdoor unit 60 to as to ensure an elevated compressor speed during dehumidification operations. For instance, upon receipt of the dehumidification signal from the thermostat 20 (e.g., via terminals 85, 89), the circuitry and/or controllers of the indoor unit 40 may electrically energize the high stage terminal 86 so as to energize the high stage terminal 91 of outdoor unit 60 (e.g., the relay 102 may be omitted).

As explained above and reiterated below, the present disclosure includes, without limitation, the following example implementations.

Clause 1: A climate control system comprising: an indoor unit including a first heat exchanger that is configured to transfer heat between a refrigerant and an airflow provided to a conditioned space; an outdoor unit including: a second heat exchanger that is configured to transfer heat between the refrigerant and an outdoor environment; a compressor configured to circulate the refrigerant through the first heat exchanger and the second heat exchanger; a thermostat that is configured to determine a relative humidity of the conditioned space and to output a dehumidification signal in response to a determination that the relative humidity is above a threshold; and an electrical switch coupled to the indoor unit and the outdoor unit that is actuatable based on the dehumidification signal to conduct electrical current from the indoor unit to the outdoor unit to increase an operating speed of the compressor to reduce the relative humidity in the conditioned space.

Clause 2: The climate control system of any of the clauses, wherein the indoor unit includes a blower that is configured to generate the airflow, and wherein the indoor unit is configured to decrease an operating speed of the blower in response to the dehumidification signal.

Clause 3: The climate control system of any of the clauses, wherein the electrical switch includes a relay that is actuatable between a first position and a second position via the dehumidification signal.

Clause 4: The climate control system of any of the clauses, wherein the relay comprises a double throw (DT) relay.

Clause 5: The climate control system of any of the clauses, wherein the thermostat is configured to determine a temperature of the conditioned space, wherein, in the first position, the relay is configured to conduct a first electrical signal from the indoor unit to the outdoor unit to increase the compressor speed based at least in part on the temperature of the conditioned space; and wherein, in the second position, the relay is configured to conduct a second electrical signal from the indoor unit to the outdoor unit to increase the compressor speed in response to the dehumidification signal, the first signal and the second electrical signal being different from one another.

Clause 6: The climate control system of any of the clauses, wherein the indoor unit includes a first terminal and a second terminal, wherein the indoor unit is configured to output the first electrical signal from the first terminal and is configured to output the second electrical signal from the second terminal; wherein the outdoor unit includes a third terminal; and wherein the relay is configured to connect the third terminal of the outdoor unit to the first terminal of the indoor unit in the first position and is configured to connect the third terminal of the outdoor unit to the second terminal of the indoor unit in the second position.

Clause 7: The climate control system of any of the clauses, wherein the relay is configured to disconnect the third terminal of the outdoor unit from the first terminal of the indoor unit in the second position.

Clause 8: A climate control system comprising: an indoor unit that is configured to condition an airflow for a conditioned space; an outdoor unit including a compressor configured to circulate a refrigerant between the indoor unit and the outdoor unit, the compressor operable at a first speed in a first stage and operable at a second speed in a second stage, the second speed being is greater than the first speed; a thermostat that is configured to determine a relative humidity of the conditioned space and to output a dehumidification signal to the indoor unit in response to a determination that the relative humidity is above a threshold; and one or more relays connected between the indoor unit and the outdoor unit that are configured to conduct electrical current from the indoor unit to the outdoor unit to operate the compressor in the second stage in response to the dehumidification signal to reduce the relative humidity in the conditioned space.

Clause 9: The climate control system of any of the clauses, wherein the dehumidification signal is configured to change an electrical energization of one or more relays to cause the one or more relays to conduct the electrical current from the indoor unit to the outdoor unit to operate the compressor in the second stage.

Clause 10: The climate control system of any of the clauses, wherein the indoor unit is configured to decrease an operating speed of an indoor blower in response to the dehumidification signal.

Clause 11: The climate control system of any of the clauses, wherein the one or more relays comprises a single relay, and wherein dehumidification signal is configured to change an electrical energization of the relay to actuate the relay from a first position to a second position.

Clause 12: The climate control system of any of the clauses, wherein the relay is coupled to an electrical power source terminal, a compressor speed terminal of the indoor unit associated with the second stage of the compressor, and a compressor speed terminal of the outdoor unit associated with the second stage of the compressor, wherein, in the first position, the compressor speed terminal of the indoor unit is electrically coupled the compressor speed terminal of the outdoor unit, and the electrical power source terminal is electrically decoupled from the compressor speed terminal of the outdoor unit, and wherein, in the second position, the compressor speed terminal of the indoor unit is electrically decoupled from the compressor speed terminal of the outdoor unit, and the electrical power source terminal is electrically coupled to the compressor speed terminal of the outdoor unit.

Clause 13: The climate control system of any of the clauses, wherein the thermostat is configured to determine a temperature of the conditioned space, and wherein when the relay is in the first position, the thermostat is configured to electrically energize the compressor speed terminal of the outdoor unit to operate the compressor in the second stage via the compressor speed terminal of the indoor unit and the relay based at least in part on the temperature of the conditioned space.

Clause 14: The climate control system of any of the clauses, wherein the electrical power source terminal is configured to output a constant supply of electrical current while the climate control system is operating.

Clause 15: An air conditioning system, comprising: a thermostat configured to monitor a temperature and a relative humidity of a conditioned space, the thermostat comprising: a first terminal associated with a first cooling demand based on the temperature; a second terminal associated with a second cooling demand based on the temperature, the second cooling demand being greater than the first cooling demand; and a third terminal associated with the relative humidity; a first conditioning unit comprising a first heat exchanger and a blower configured to generate an airflow past the first heat exchanger in at least a first blower speed, a second blower speed, and a third blower speed, the first blower speed being less than the second blower speed, and the second blower speed being less than the third blower speed; a second conditioning unit comprising a second heat exchanger and a compressor configured to circulate a refrigerant between the first heat exchanger and the second heat exchanger, the compressor having a first speed and a second speed, the first speed being less than the second speed; and wiring coupling the thermostat to the first conditioning unit and the second conditioning unit such that: when only the first terminal of the first, second, and third terminals are active on the thermostat, the blower operates at the second blower speed and the compressor operates at the first speed; when only the first and second terminals of the first, second, and third terminals on the thermostat are active, the blower operates at the third blower speed and the compressor operates at the second speed; and when only the first and third terminals of the first, second, and third terminals are active, the blower operates at the first blower speed and the compressor operates at the second speed.

Clause 16: The air conditioning system of any of the clauses, wherein the first and second terminals are active when they are energized respectively, and the third terminal is active when it is de-energized.

Clause 17: The air conditioning system of any of the clauses, wherein the wiring comprises a double throw (DT) relay electrically coupled to the second terminal and the third terminal of the thermostat.

Clause 18: The air conditioning system of any of the clauses, wherein the DT relay comprises a double pole DT (DPDT) relay.

Clause 19: The air conditioning system of any of the clauses, wherein the DT relay comprises a single pole DT (SPDT) relay.

Clause 20: The air conditioning system of any of the clauses, wherein when the first output is not active, the blower and the compressor are deactivated.

Clause 21: A method of retrofitting an existing climate control system of a conditioned space to enhance dehumidification functionality, the climate control system including an indoor unit, an outdoor unit, and a thermostat, the outdoor unit including a compressor that is configured to circulate a refrigerant in the climate control system, the method comprising: (a) electrically coupling an electrical switch to an indoor unit and an outdoor unit of a climate control system so that the electrical switch assembly is configured to conduct an electrical signal to increase a speed of the compressor from a compressor speed terminal of the indoor unit to a compressor speed terminal of the outdoor unit; (b) electrically coupling the electrical switch to an electrical power source terminal of the climate control system; and (c) electrically coupling the electrical switch to a dehumidification terminal of the climate control system that is associated with a dehumidification signal output by the thermostat so that the dehumidification signal is configured to actuate the electrical switch assembly to change a connection of the compressor speed terminal of the outdoor unit from the compressor speed terminal of the indoor unit to the electrical power source terminal, to thereby increase the speed of the compressor to dehumidify the conditioned space.

Clause 22: The method of any of the clauses, wherein the dehumidification terminal is positioned on the indoor unit and is further electrically coupled to the thermostat, and wherein the indoor unit is further configured to reduce an operating speed of a blower in response to an energization of the dehumidification terminal.

Clause 23: The method of any of the clauses, wherein the electrical power source terminal is positioned on the indoor unit, and wherein the electrical power source terminal is configured to output a constant supply of electrical current.

Clause 24: The method of any of the clauses, wherein (c) comprises electrically coupling the electrical switch assembly to the dehumidification terminal so that an absence of the dehumidification signal is configured to actuate the electrical switch assembly to change a connection of the compressor speed terminal of the outdoor unit from the electrical power source terminal to the compressor speed terminal of the indoor unit so that the speed of the compressor is increased when the compressor speed terminal of the indoor unit is energized.

Clause 25: A method comprising: (a) circulating, via a compressor, a refrigerant between a first heat exchanger of an indoor unit and a second heat exchanger of an outdoor unit of a climate control system to condition an airflow provided to a conditioned space; (b) outputting a dehumidification signal from a thermostat to the indoor unit in response to a determination that a relative humidity of the conditioned space is above a threshold; (c) reducing an operating speed of a blower of the indoor unit to reduce a speed of the airflow in response to the dehumidification signal; and (d) actuating an electrical switch electrically coupled to the indoor unit and the outdoor unit by use of the dehumidification signal to conduct electrical current from the indoor unit to the outdoor unit to increase an operating speed of the compressor during (c) to reduce the relative humidity in the conditioned space.

Clause 26: The method of any of the clauses, wherein (d) comprises, changing an electrical energization of a relay of the electrical switch by use of the dehumidification signal to electrically couple a terminal of the outdoor unit to an electrical source terminal of the indoor unit via the relay.

The embodiments disclosed herein include systems and methods for enhancing the dehumidification functionality of an existing climate control system that may lack additional sensing, communication, and/or control systems that are typically associated with communicating climate control system models. In some embodiments, the systems and methods may include one or more electrical switches that may be electrically coupled to an existing two-stage climate control system that may allow for coordinated, automatic adjustments of multiple components of the climate control system to improve dehumidification functionality of the climate control system during operations. Thus, through use of the embodiments disclosed herein, an existing climate control system may enjoy improved dehumidification functionality via a bolt-on solution without additional modifications of other major components, thereby providing an economically feasible improvement for a greater number of consumers.

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A climate control system comprising:

an indoor unit including a first heat exchanger that is configured to transfer heat between a refrigerant and an airflow provided to a conditioned space;

an outdoor unit including:

a second heat exchanger that is configured to transfer heat between the refrigerant and an outdoor environment;

a compressor configured to circulate the refrigerant through the first heat exchanger and the second heat exchanger; and a thermostat that is configured to determine a relative humidity and a temperature of the conditioned space and to output a dehumidification signal in response to a determination that the relative humidity is above a threshold; and an electrical switch coupled to the indoor unit and the outdoor unit that is actuatable based on the dehumidification signal to conduct electrical current from the indoor unit to the outdoor unit to increase an operating speed of the compressor to reduce the relative humidity in the conditioned space, wherein the electrical switch includes a relay that is actuatable between a first position and a second position via the dehumidification signal, wherein, in the first position, the relay is configured to conduct a first electrical signal from the indoor unit to the outdoor unit to increase the operating speed of the compressor based at least in part on the temperature of the conditioned space; and wherein, in the second position, the relay is configured to conduct a second electrical signal from the indoor unit to the outdoor unit to increase the operating speed of the compressor in response to the dehumidification signal, the first electrical signal and the second electrical signal being different from one another.

2. The climate control system of claim 1, wherein the indoor unit includes a blower that is configured to generate the airflow, and wherein the indoor unit is configured to decrease an operating speed of the blower in response to the dehumidification signal.

3. The climate control system of claim 1, wherein the relay comprises a double throw (DT) relay.

4. The climate control system of claim 1, wherein the indoor unit includes a first terminal and a second terminal, wherein the indoor unit is configured to output the first electrical signal from the first terminal and is configured to output the second electrical signal from the second terminal;

wherein the outdoor unit includes a third terminal; and wherein the relay is configured to connect the third terminal of the outdoor unit to the first terminal of the indoor unit in the first position and is configured to connect the third terminal of the outdoor unit to the second terminal of the indoor unit in the second position.

5. The climate control system of claim 4, wherein the relay is configured to disconnect the third terminal of the outdoor unit from the first terminal of the indoor unit in the second position.

6. A climate control system comprising:

an indoor unit that is configured to condition an airflow for a conditioned space;

an outdoor unit including a compressor configured to circulate a refrigerant between the indoor unit and the outdoor unit, the compressor operable at a first speed in a first stage and operable at a second speed in a second stage, the second speed being is greater than the first speed;

a thermostat that is configured to determine a relative humidity of the conditioned space and to output a dehumidification signal to the indoor unit in response to a determination that the relative humidity is above a threshold; and a relay connected between the indoor unit and the outdoor unit that is configured to conduct electrical current from the indoor unit to the outdoor unit to operate the compressor in the second stage in response to the dehumidification signal to reduce the relative humidity in the conditioned space;

wherein the relay is coupled to an electrical power source terminal, a compressor speed terminal of the indoor unit associated with the second stage of the compressor, and a compressor speed terminal of the outdoor unit associated with the second stage of the compressor;

wherein the dehumidification signal is configured to change an electrical energization of the relay to cause the relay to conduct the electrical current from the indoor unit to the outdoor unit to operate the compressor in the second stage;

wherein the dehumidification signal is configured to change an electrical energization of the relay to actuate the relay from a first position to a second position;

wherein, in the first position, the compressor speed terminal of the indoor unit is electrically coupled the compressor speed terminal of the outdoor unit, and the electrical power source terminal is electrically decoupled from the compressor speed terminal of the outdoor unit; and wherein, in the second position, the compressor speed terminal of the indoor unit is electrically decoupled from the compressor speed terminal of the outdoor unit, and the electrical power source terminal is electrically coupled to the compressor speed terminal of the outdoor unit.

7. The climate control system of claim 6, wherein the indoor unit is configured to decrease an operating speed of an indoor blower in response to the dehumidification signal.

8. The climate control system of claim 6, wherein the thermostat is configured to determine a temperature of the conditioned space, and wherein when the relay is in the first position, the thermostat is configured to electrically energize the compressor speed terminal of the outdoor unit to operate the compressor in the second stage via the compressor speed terminal of the indoor unit and the relay based at least in part on the temperature of the conditioned space.

9. The climate control system of claim 6, wherein the electrical power source terminal is configured to output a constant supply of electrical current while the climate control system is operating.

10. An air conditioning system, comprising:

a thermostat configured to monitor a temperature and a relative humidity of a conditioned space, the thermostat comprising:

a first terminal associated with a first cooling demand based on the temperature;

a second terminal associated with a second cooling demand based on the temperature, the second cooling demand being greater than the first cooling demand; and a third terminal associated with the relative humidity;

a first conditioning unit comprising a first heat exchanger and a blower configured to generate an airflow past the first heat exchanger in at least a first blower speed, a second blower speed, and a third blower speed, the first blower speed being less than the second blower speed, and the second blower speed being less than the third blower speed;

a second conditioning unit comprising a second heat exchanger and a compressor configured to circulate a refrigerant between the first heat exchanger and the second heat exchanger, the compressor having a first speed and a second speed, the first speed being less than the second speed; and wiring coupling the thermostat to the first conditioning unit and the second conditioning unit such that:

when only the first terminal of the first, second, and third terminals is active on the thermostat, the blower operates at the second blower speed and the compressor operates at the first speed;

when only the first and second terminals of the first, second, and third terminals on the thermostat are active, the blower operates at the third blower speed and the compressor operates at the second speed; and when only the first and third terminals of the first, second, and third terminals are active, the blower operates at the first blower speed and the compressor operates at the second speed.

11. The system of claim 10, wherein the first and second terminals are active when they are energized respectively, and the third terminal is active when it is de-energized.

12. The system of claim 10, wherein the wiring comprises a double throw (DT) relay electrically coupled to the second terminal and the third terminal of the thermostat.

13. The system of claim 12, wherein the DT relay comprises a double pole DT (DPDT) relay.

14. The system of claim 12, wherein the DT relay comprises a single pole DT (SPDT) relay.

15. The system of claim 10, wherein when the first terminal is not active, the blower and the compressor are deactivated.

* * * * *